US012259204B2

(12) United States Patent
Reis-Green

(10) Patent No.: US 12,259,204 B2
(45) Date of Patent: Mar. 25, 2025

(54) SOUND SUPPRESSOR FOR ENHANCED USER SERVICABILITY

(71) Applicant: Austin Reis-Green, Watertown, WI (US)

(72) Inventor: Austin Reis-Green, Watertown, WI (US)

( * ) Notice: Subject to any disclaimer, the term of this patent is extended or adjusted under 35 U.S.C. 154(b) by 0 days.

(21) Appl. No.: 18/456,643

(22) Filed: Aug. 28, 2023

(65) Prior Publication Data

US 2024/0271898 A1 Aug. 15, 2024

Related U.S. Application Data

(60) Provisional application No. 63/377,608, filed on Sep. 29, 2022.

(51) Int. Cl.
*F41A 21/30* (2006.01)

(52) U.S. Cl.
CPC ..... *F41A 21/30* (2013.01)

(58) Field of Classification Search
CPC ..... F41A 21/30
See application file for complete search history.

(56) References Cited

U.S. PATENT DOCUMENTS

| | | | | |
|---|---|---|---|---|
| 1,482,805 | A | 2/1924 | Maxim | |
| 3,677,132 | A | 7/1972 | Plenge | |
| 6,079,311 | A | 6/2000 | O'Quinn et al. | |
| 7,600,606 | B2 | 10/2009 | Brittingham | |
| 7,856,914 | B2 | 12/2010 | Shults et al. | |
| 8,453,789 | B1 | 6/2013 | Honigmann et al. | |
| 8,739,922 | B2 | 6/2014 | Wirth et al. | |
| 9,816,773 | B1 | 11/2017 | Reis Green et al. | |
| 10,330,417 | B2 | 6/2019 | Reis Green et al. | |
| 10,458,739 | B2 | 10/2019 | Smith | |
| 2015/0285575 | A1 | 10/2015 | Sclafani | |
| 2016/0018179 | A1* | 1/2016 | Morris | F41A 21/30 181/223 |
| 2021/0254920 | A1* | 8/2021 | Miller | F41A 21/30 |
| 2024/0068763 | A1* | 2/2024 | Piche | F41A 21/30 |

* cited by examiner

*Primary Examiner* — J. Woodrow Eldred
(74) *Attorney, Agent, or Firm* — Dunlap Bennett & Ludwig, PLLC

(57) ABSTRACT

A sound suppressor for enhanced user serviceability is provided. The sound suppressor uses high temperature elastomer O-rings to maintain the alignment of the parts in assembly, to prevent loosening of the end caps, and most notably, to seal the suppressor baffles and end caps, so that carbon does not interact with the outer tube around the baffles, or the threads or connective geometry of the outer tube. This prevents carbon from locking the baffles in the tube, and allows ease of end user disassembly after extended amounts of rounds are fired, protecting the ability to maintain and service the sound suppressor without damage to the baffles or outer tube. This protects the end user's investment in the suppressor, as well as their investment in their $200 National Firearms Act Tax Stamp associated with the purchase of the sound suppressor.

9 Claims, 3 Drawing Sheets

SOUND SUPPRESSOR FOR ENHANCED USER SERVICABILITY

CROSS-REFERENCE TO RELATED APPLICATION

This application claims the benefit of priority of U.S. provisional application No. 63/377,608, U.S. provisional application number filed 29 Sep. 2022, the contents of which are herein incorporated by reference.

BACKGROUND OF THE INVENTION

The present invention relates to firearm suppressors and, more particularly, to a sound suppressor that may be easily disassembled for cleaning and maintenance after extended use.

In 1921, Hiram Percy Maxim filed U.S. Pat. No. 1,482,805A, a patent on the Maxim model 1920 suppressor which was able to be assembled or disassembled via a threaded end cap and an alignment rod tool. This demonstrated the first recognized product designed to provide firearm silencer end users with a silencer that can be disassembled for cleaning or perhaps for replacement of parts. The reason for disassembly is not specified, and the patent pre-dates the 1934 National Firearms Act, so this was prior to the imposition of the $200 transfer tax on the silencer purchase. The Maxim design is a basic design, which doesn't confront the need for the silencer baffle system to protect the tube inside diameter from lead and carbon fouling which will attempt to fuse all the components to the baffle tube, like brazing, rendering disassembly difficult or impossible after significant use. This is understandable in that this is a pioneering invention.

In the period after the 1921 patent several patents were filed that described O-rings for sealing the rear cap of suppressors from leakage to the atmosphere, or in the case of U.S. Pat. No. 3,677,132, from the incursion of water during Naval swimmer operations, but there are no examples of the use of O-rings to seal the suppressor baffles from the outer tube housing for the purpose of providing end users unprecedented ease of disassembly after extended use.

In 2000, with U.S. Pat. No. 6,079,311, Carl L. O'Quinn's disassemble-able silencer-provided a monolithic silencer core with a thread that permits assembly into the barrel or silencer tube housing. This design of course, fails to attempt to provide any provision at all for fouling. Such a design would become very difficult to disassemble after even light to moderate use, as the twisting of the core would have to remove all deposited lead and carbon to permit rotation to occur.

As early as approximately 2005, John Titsworth, independent silencer sound testing service provider, and founder of Silencer Research, was vocal about the need for sound suppressors to be user disassembled for cleaning. Silencer Research was a website where consumers could go to see independent sound test results for silencers, and a forum where end users could discuss silencers. It is obvious in light of pursuant inventions, that Silencer Research was relatively in touch with customer issues at the time. In U.S. Pat. No. 7,600,606B2, dated 20 Jul. 5, 2001, Kevin Brittingham teaches a tapered tube wall, comprised of tapered steps intended to facilitate the disassembly of the suppressor tube from the similarly tapered steps of the monolithic baffle core. This design of course, was intended to be coupled with frequent cleaning at intervals of ~250-500 rounds such that fouling from extremely dirty lead rimfire ammunition did not reach a level that the taper, or subsequent steps were irrelevant to disassembly due to the fouling reaching a greater deposited thickness than the step and taper mitigation system.

In U.S. Pat. No. 7,856,914B2, dated 20 Aug. 11, 2026, Jonathon Shultz and Michael Pappas teach an attempt to improve upon the prior art—a monolithic core baffle system with two tube clamshell halves to protect the tube from low round count fouling. The U.S. Pat. No. 7,856,914B2 silencer again emphasizes the ability to get the core out of the National Firearms Act registered, tube which is associated with a $200 NFA purchasing transfer tax. The emphasis on protecting the tube is related to the ability of the manufacturer to replace components, but not the tube of the suppressor. Today the $200 tax is generally associated to the serialized outer tube. The U.S. Pat. No. 7,856,914B2 design was remarkable at the time, widely desired, and is still popular today, but it has three weakness. Firstly, the monolithic baffles are weaker, and do not provide market leading sound performance, especially as it pertains to first round pop, so the need to be monolithic to use the halves is already a significant performance compromise. The clamshell halves do not provide a seal that completely protects the tube from fouling, and the relatively fragile and thin tube clamshell halves can be damaged during their removal from the core. This condition is most probable when the suppressor is at higher round counts between maintenance intervals. The lead and carbon braze the core to these tube halves and so they may have to be mechanically peeled or separated from the core with improvised tools if the end user does not keep the silencer cleaned at ~250 to 500 round count intervals. The 500 round count intervals represent a lot of frequent undesirable maintenance work for a rimfire customer, which might commonly go through that amount of rounds in one afternoon at the range. Range rental businesses which allow customers to pay by the hour may see that number of rounds multiple times per day, and rental units may not be cleaned for weeks or months at a time. One can see the consumer driven market demand for the U.S. Pat. No. 7,856,914B2 design in terms of the appearance of the less functional single cut inner tube of both 2011 patent U.S. Pat. No. 8,739,922B2, and 2012 patent U.S. Pat. No. 8,453,789B1.

In 2015 Michael Sclafani filed US 20150285575A1 this design used a 3D printed core which was sealed by nature of its homogenous construction but lacked seals to keep the outer tube from becoming fouled. Its homogenous construction renders physical removal of fouling from the core impossible.

In 2017 Michael Leighton Smith filed U.S. Pat. No. 10,458,739B2; another patent with intent "facilitating the quick and easy removal and disassembly of the baffle core from the silencer body for cleaning and/or maintenance thereof." The baffles in the patent are a modified version of a shielded K baffle type developed by Gemtech and used in their circa 2011 "Alpine" suppressor. A tubular spacer encapsulates the K baffle to an extent and reduces the fouling bleed out of the baffle system but does not eliminate it. This reduces the difficulty in getting the core out of the tube again at frequent, low use intervals, but doesn't eliminate the difficulty at higher round counts. It also does not increase the ease of getting the baffles apart for cleaning or replacement of individual components, as the lower conical part of the K baffle can be carbon locked into the rearward facing tubular section. This carbon bound condition of geometries inside the tubular section is just as it would have been for the previously problematic outer tube of a silencer without the tubular encompassing spacer.

As can be seen, there is a need for a user configurable firearm suppressor that can be quickly and easily disassembled for both cleaning and maintenance, especially after higher round count maintenance intervals.

SUMMARY OF THE INVENTION

The present disclosure relates to a silencer or noise suppressor for a firearm which includes an external tube with proximal receiving and distal discharge ends. The tube proximal end operatively associates with a proximal receiving end silencer mount interface comprising a receiving bore releasably securable to a firearm or firearm barrel end adaptor, or adaptor mounting system, and a distal end bore capable of operatively associating with a baffle O-ring. The silencer includes a baffle assembly having a series of baffles that each have an annular groove for an O-ring seal, allowing the baffles to be aligned and stacked, defining a baffle stack or baffle core unit. The baffle core can be readily removed or installed in the tube, whereupon the O-ring on the most proximal baffle operatively associates with the proximal silencer mount interface distal end bore, sealing the proximal receiving end silencer mount interface to the baffle core. The silencer includes a distal end front cap with external annual groove for an O-ring seal. The distal end front cap can be operatively associated with the distal or forward side of the tube, allowing the cap O-ring to completely seal the baffle core from the outer tube. The firearm equipped with the silencer of the present disclosure can be fired without exhaust gases interacting with the inside diameter of the external tube or with the internal connective geometries of the external tube. This allows the silencer baffle core to be readily installed and removed for cleaning and maintenance, without impact to the cleanliness or operability of the tube internal connective geometries.

In one aspect of the present invention, a firearm suppressor includes the following: a cylindrical body having a proximal end and a distal end, wherein the cylindrical body has an inner surface defining an internal bore; a plurality of baffles in a stack arrangement is disposed within the internal bore; each baffle includes: a tubular base; a frusto-conical sidewall; and an annular groove interconnecting the tubular base, the tubular base having an internal circumferential surface dimensioned so that an O-ring operatively associated with the annular groove forms a sealed engagement with the internal circumferential surface of a proximal baffle in the stacked arrangement, whereby the sealed engagement prevents exhaust carbon and lead from entering the internal bore between the baffles.

In another aspect of the present invention, the firearm suppressor further includes the following: an O-ring operatively associated with each annular groove; a distal end cap dimensioned to operatively associated with the distal end; and the distal end cap providing an outer surface having an annular groove nesting an O-ring, wherein said O-ring forms the sealed engagement with the internal circumference of the distal most baffle in the stacked arrangement, wherein the distal end cap defines a discharge bore, wherein the distal end cap provides a first threading mechanically connectable with a second threading along an inner circumferential surface of the distal end, wherein the proximal end provides a connective adapter interface for operative association of a firearm component, wherein the proximal end provides a connective adapter interface for operative association with a firearm component, wherein the connective adapter interface provides an inner surface that the O-ring of the proximal-most baffle in the stacked arrangement form the seal engagement, wherein the connective adapter interface defines, in part, a receiving bore, wherein each baffle defines an axial bore, and wherein said series of sealed engagements promotes concentricity of the receiving bore, the discharge bore and each axial bore, wherein each frusto-conical sidewall is disposed in the circumferential surface of the proximal baffle in the stack arrangement, and wherein for each baffle the tubular base is distal relative to the frusto-conical sidewall.

These and other features, aspects and advantages of the present invention will become better understood by those skilled in the art, upon reference to the following drawings, description and claims.

DETAILED DESCRIPTION OF THE INVENTION

Figure 1:
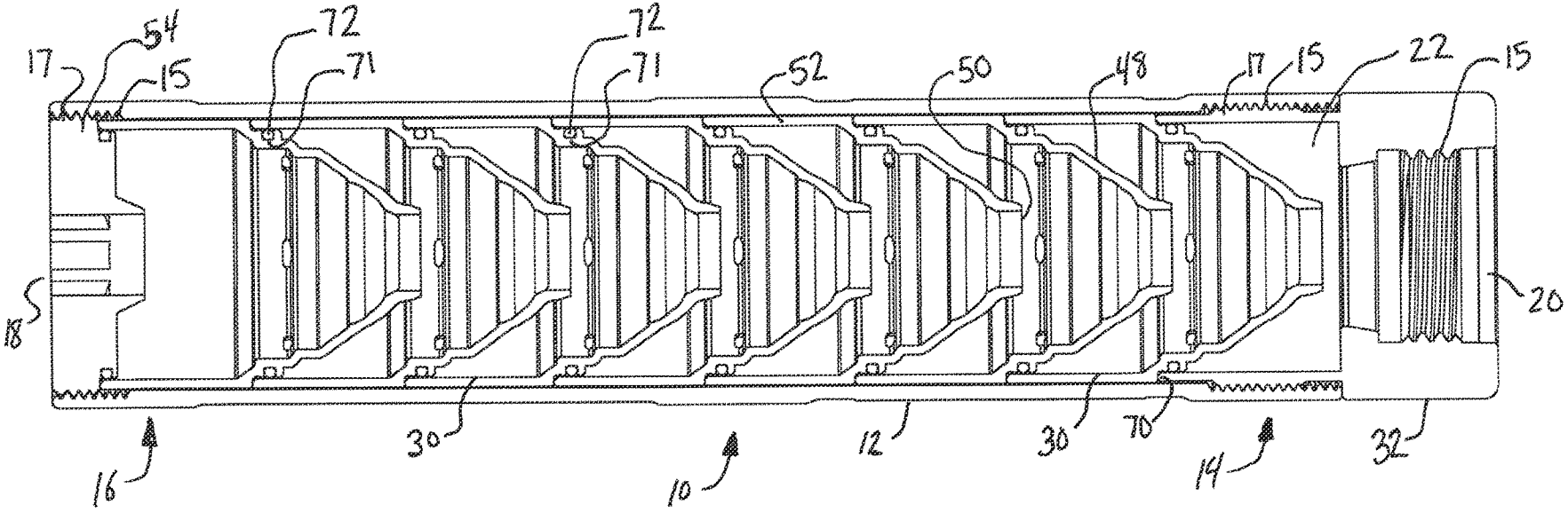
FIG. 1 is a side section view of an embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

A sound suppressor with enhanced user serviceability is provided. The suppressor includes a cylindrical body having first end and a second end opposite the first end. The cylindrical body may be one component, or may be comprised of two modular components to derive user configurable length, a practice now common in the industry that began with the Griffin Revolution series suppressors of my design circa 2013. The cylindrical body includes an internal bore, the first end includes a receiving bore and the second end includes a discharge bore aligning with one another. The internal bore includes a plurality of baffles. The distal end of the discharge bore operatively associates with the discharge end cap which retains the baffles in the bore. The proximal portion includes a bore with connective geometry for operatively associating with a firearm mount interface. The interface may permit direct operative association with connective geometry machined into a firearm barrel, or with a firearm barrel end adapter, or with a firearm mount interface such as a pistol recoil booster or universal interface adapter referred to in industry as "HUB" or "1.375×24 universal interface". In some instances, this connective geometry may be machined natively into the proximal end of the cylindrical body, or—in the case of a two-piece cylindrical body—to the more proximal of two components comprising the cylindrical body. A portion of the outer circumference of each of the plurality of baffles comprise an annular groove for receiving a high temperature elastomer sealing O-ring. The O-ring may be made of different materials, depending on the temperature range of the application. For example Silicone with 450 degree Fahrenheit service temperature, may be used in a rimfire suppressor.

The baffles when stacked and installed comprise a "baffle stack" or "baffle core" which is sealed via the O-rings, such that firearm muzzle exhaust gases are prohibited from leaving the baffle core to foul the inside diameter of the cylindrical body.

The distal cap may feature an O-ring capable of contributing to this sealed engagement of the baffle core, and the proximal mount interface may also feature an O-ring seal, or interface for an O-ring seal. This assembly in a preferred embodiment will provide protection from fouling for the connective geometries of the cylindrical body, and the outside diameter of the baffle stack or core. This protection will afford the end user the ability to easily remove the baffle core for maintenance or replacement without requiring tedious maintenance at short intervals. It is obvious that this protective function could be re-arranged by such means as O-ring sealing the rear cap to the tube, and O-ring sealing the baffle core to the tube without departing from the spirit and scope of this invention.

The suppresser of the present invention may be utilized with different types of firearms. The design is capable of supporting rimfire applications, centerfire pistol and submachine gun applications, and even centerfire hunting rifle applications. The suppressor of the present invention confronts a major end user issue—the carbon binding of suppressor system components from extended firing. Without this sealed construction, the suppressor system components are more likely to be brazed together by carbon, lead, and copper fouling. The O-rings also offer an assistive function in maintaining the axial alignment of components, and providing low prevailing torque to keep the proximal and distal ends from loosening at their connective and associated geometries. The O-ring groove dimensions can be altered as necessary to achieve differential axial holding force as desired to allow the assembly without the loss of desired system component alignment.

Figure 3:
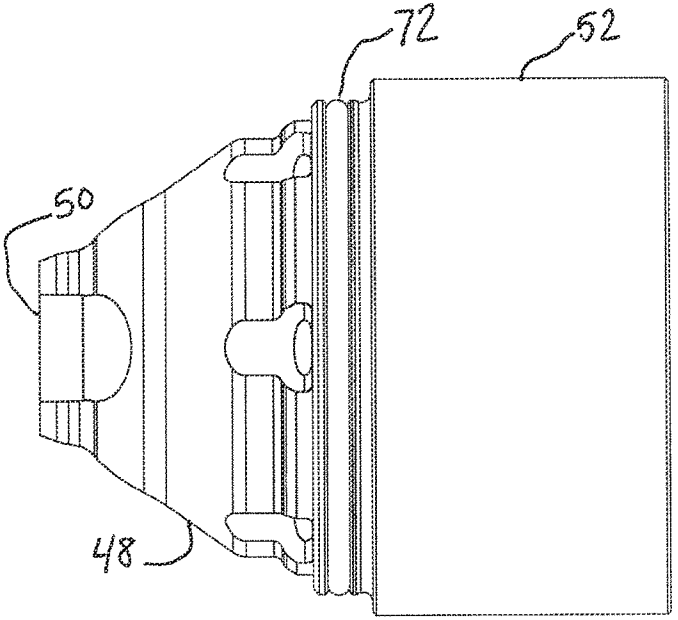
FIG. 3 is a side view of a baffle of the suppressor of the present invention.
Figure 2:
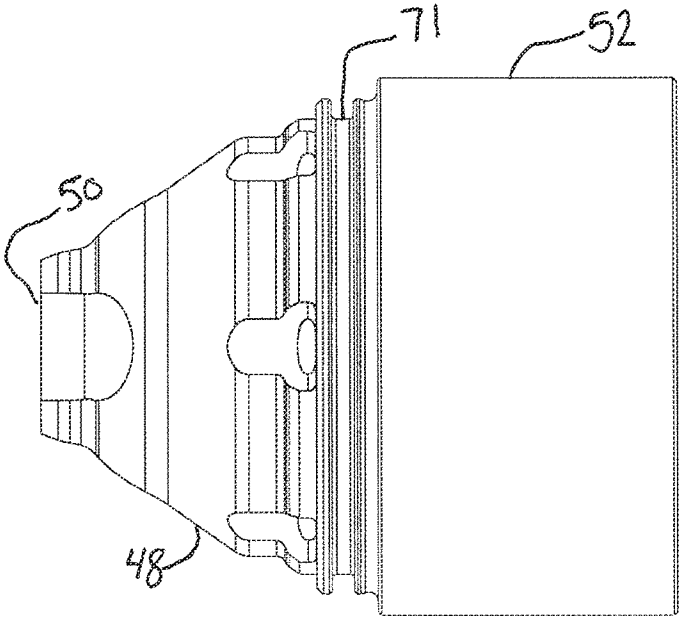
FIG. 2 is a side view of a baffle of the suppressor of the present invention.
Figure 4:
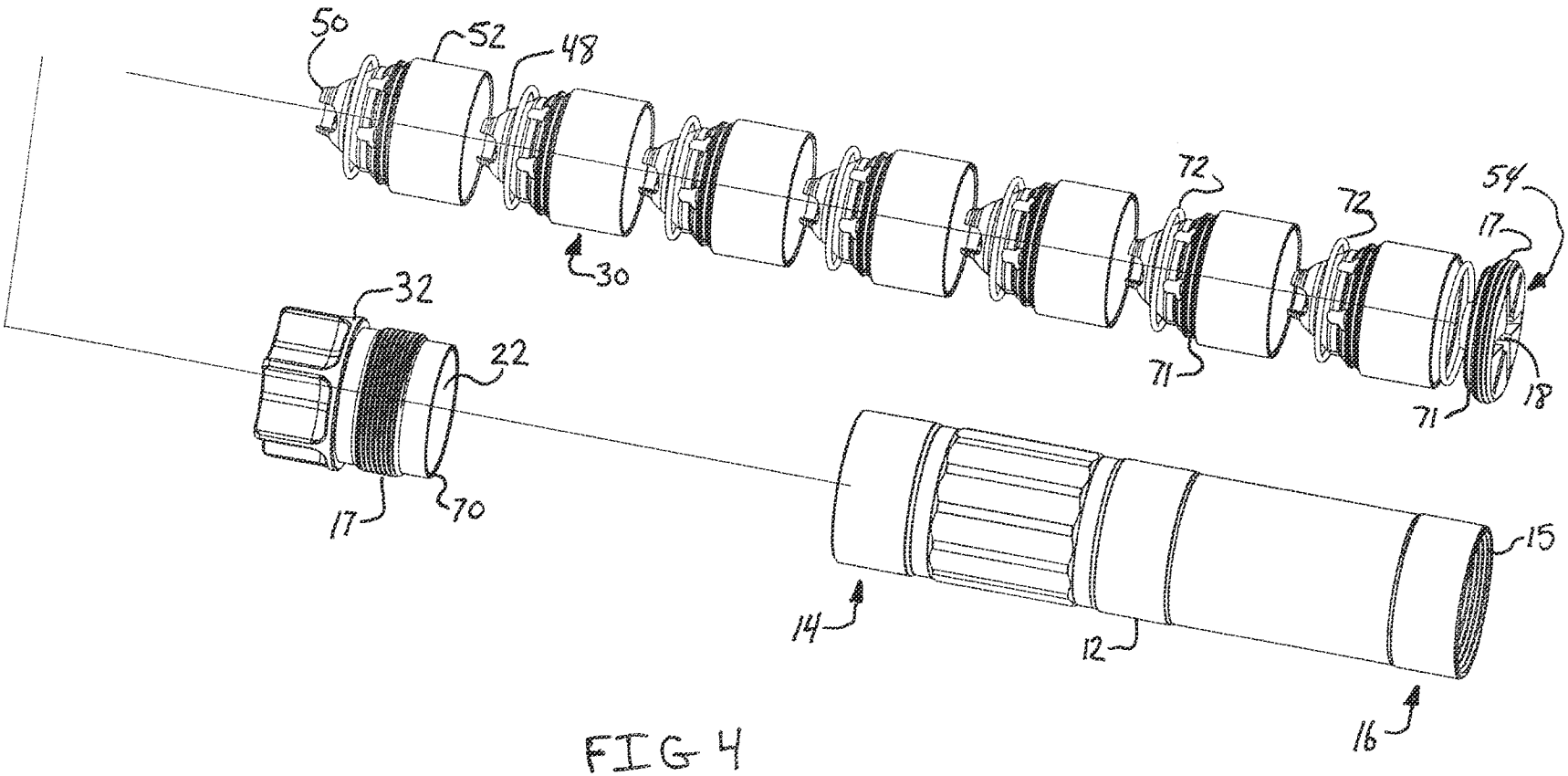
FIG. 4 is an exploded view of an embodiment of the present invention.

Referring to FIGS. 1 through 4, the present invention includes a firearm suppressor 10. The firearm suppressor 10 includes a cylindrical body 12 having a proximal first end 14 opposite a distal second end 16. The second end 16 includes a discharge bore 18. A firearm mount interface 32 is releasably secured to the first end 14. In certain embodiments, the first end of the cylindrical body 12 may include female threads 15 that mechanically fasten to male threads 17 of the firearm mount interface 32. The firearm mount interface 32 includes a receiving bore 20 that releasably secures to an end of a barrel of a firearm, or to a firearm barrel end adaptor, or mounting system accessory. An internal bore 22 is formed by an inner distal surface of the firearm mount interface 32 or cylindrical body 12, and the inner surface of the baffles 30. A plurality of baffles 30 are disposed within the cylindrical body 12.

Each of the baffles 30 of the present invention may include a frusto-conical sidewall 48. The frusto-conical sidewall 48 includes an apex having an axial bore 50 and a tubular base 52 opposite the apex. The apex is disposed towards the receiving bore 20 and the base 52 is disposed toward the discharge bore 18.

The baffles 30 are removable from the cylindrical body 12. A sealing, and motion limiting ledge may be formed on the inner surface of the distal portion the cylindrical body 12, or in the preferred embodiment, is formed by the forward edge 70 of the rear mount interface 32. The base of the most proximal baffle 30 abuts against the ledge of cylindrical body 12, or forward most face 70 of rear mount interface 32. The second end of the cylindrical body 12 may also include female threads 15. A discharge end cap 54 may include male threads 17 that mechanically fasten to the female threads 15 of the distal second end 16 of the cylindrical body 12. The discharge end cap 54 may include the discharge bore 18. The inner, outside diameter surface of the discharge end cap 54 may include an annular groove 71 nesting an O-ring 72. The baffles 30 also feature an outside diameter annular groove 71 nesting an O-ring 72. The baffles 30 are stacked within the cylindrical body 12, and the discharge cap 54 is abutting the forward most baffle 30, at the most distal edge of its base 52. The O-rings 72 seal the baffles, prohibiting firearm exhaust gas introduced into distal bore 22 from impinging the inner surface of the cylindrical body 12 in the region surrounding the baffles 30, as the exhaust gas travels through axial bores 50 and eventually exits discharge bore 18. The sealing engagement of the O-rings 72 to the tubular bases 52 of adjacent baffles 30 also removes tolerance, promoting concentricity, dampening vibration, prohibiting the baffles 30 from rotating, and retaining the discharge end cap 54 and rear mount interface 32 in place, preventing the undesired loosening of the distal discharge end cap 54, or proximal rear mount interface 32.

To remove the baffles 30 for cleaning, the discharge end cap 54 is unscrewed from the second end 16 of the cylindrical body 12. The baffles 30 may then be pushed out of the cylindrical body 12 with only modest effort, unlike the prior art, because the internal bore in the cylindrical body 12 has remained clean and unobstructed, due to the seals 72 of baffles 30 preventing incursion of exhaust gas into the space between baffles 30 and the inner surface of the internal bore of the cylindrical body 12. The prevention of exhaust gas incursion prevents the physical vapor deposition of lead, carbon, and copper which would otherwise act to braze the baffles to the tube.

The cylindrical body 12 of the present invention allows users to interchange between different types of firearm mount interfaces 32. Therefore, the firearm suppressor 10 of the present invention may be used with different types of firearms.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. A firearm suppressor comprising:

a cylindrical body having a proximal end and a distal end, wherein the cylindrical body has an inner surface defining an internal bore;

a plurality of baffles in a stack arrangement is disposed within the internal bore;

each baffle comprises:

a tubular base, wherein an internal circumferential surface;

a frusto-conical sidewall;

an annular groove disposed between the frusto-conical sidewall and the tubular base; and a baffle O-ring operatively associated with the annular groove so as to form a sealed engagement with the internal circumferential surface of an adjacent baffle in the stacked arrangement, whereby the sealed engagement prevents exhaust carbon and lead from escaping the O-ring seals.

2. The firearm suppressor of claim 1, further comprising:

a distal end cap dimensioned to operatively associate with the distal end; and the distal end cap providing an outer surface having an annular groove nesting a cap O-ring, wherein said cap O-ring forms cap sealed engagement with the internal circumference of the distal most baffle in the stacked arrangement.

3. The firearm suppressor of claim 2, wherein the distal end cap defines a discharge bore.

4. The firearm suppressor of claim 3, wherein the distal end cap provides a first threading mechanically connectable with a second threading along an inner circumferential surface of the distal end.

5. The firearm suppressor of claim 4, wherein the proximal end provides a connective adapter interface for operative association of a firearm component.

6. The firearm suppressor of claim 5, wherein the connective adapter interface provides an inner surface that the O-ring of the proximal-most baffle in the stacked arrangement operably associates to form the sealed engagement.

7. The firearm suppressor of claim 6, wherein the connective adapter interface defines, in part, a receiving bore.

8. The firearm suppressor of claim 6, wherein each baffle defines an axial bore concentric with the receiving bore and the discharge bore.

9. The firearm suppressor of claim 8, wherein each frusto-conical sidewall is disposed within the internal circumferential surface of the adjacent baffle in the stack arrangement, and wherein for each baffle the tubular base is distal relative to the frusto-conical sidewall.

* * * * *